US007920707B2

(12) United States Patent
Tsutsui

(10) Patent No.: US 7,920,707 B2
(45) Date of Patent: Apr. 5, 2011

(54) AUDIO SYSTEM

(75) Inventor: Takashi Tsutsui, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 1450 days.

(21) Appl. No.: 11/324,742

(22) Filed: Jan. 3, 2006

(65) Prior Publication Data

US 2006/0159276 A1 Jul. 20, 2006

(30) Foreign Application Priority Data

Jan. 11, 2005 (JP) ..... 2005-003389

(51) Int. Cl.
*H04R 5/00* (2006.01)
*H04R 29/00* (2006.01)
*H04R 5/02* (2006.01)

(52) U.S. Cl. ..... 381/17; 381/1; 381/18; 381/56; 381/59; 381/302; 381/309; 381/310; 381/307; 381/306

(58) Field of Classification Search ..... 381/59, 381/308, 58, 307, 309, 17, 18, 1, 302, 310; 701/211, 21
See application file for complete search history.

(56) References Cited

U.S. PATENT DOCUMENTS

| | | | | |
|---|---|---|---|---|
| 5,119,420 | A | 6/1992 | Kato et al. | |
| 7,075,592 | B2 | 7/2006 | Morikawa | |
| 7,366,607 | B2 * | 4/2008 | Nakaishi et al. | 701/211 |
| 7,369,667 | B2 * | 5/2008 | Yamada | 381/309 |
| 2004/0264704 | A1 * | 12/2004 | Huin et al. | 381/59 |

FOREIGN PATENT DOCUMENTS

| | | |
|---|---|---|
| JP | 04-117100 | 4/1992 |
| JP | 6-233177 | 8/1994 |
| JP | 10-248098 | 9/1998 |
| JP | 2003-244800 | 8/2003 |
| JP | 2004-040577 | 2/2004 |

OTHER PUBLICATIONS

Japanese Office Action (Notification for Reasons of Refusal) in Japanese Application No. 2005-003389, dated Nov. 24, 2009, with English language translation, 5 pages.
Notification for Reasons of Refusal in Japanese Application No. 2005-003389, dated Dec. 14, 2010, English Translation with original Japanese document, 8 pages.

* cited by examiner

*Primary Examiner* — Devona E Faulk
(74) *Attorney, Agent, or Firm* — Brinks Hofer Gilson & Lione

(57) ABSTRACT

The designation of a localization position is received in accordance with an input position on a dashboard image in a localization-position reception window, and delay times for audio signals supplied to respective speakers are set so that the sound image is localized at the received localization position. The position where a sound image aurally perceived is localized is received, on the dashboard image in a localization-position confirmation window, from the user, until the user indicates that the position where the sound image aurally perceived is localized matches the localization position designated in the localization-position reception window. The relationship between the delay times and the localization position is re-estimated so as to correspond to the received localization position and the set delay times. In accordance with the estimated relationship, processing for re-setting the delay times is repeated.

18 Claims, 10 Drawing Sheets

AUDIO SYSTEM

BACKGROUND OF THE INVENTION

1. Field of the Invention

The present invention relates to a technology for controlling the localization position of a sound image by providing a delay-time difference between outputs of speakers in an audio system.

2. Description of the Related Art

An example of known technology for controlling the position of sound image localization by providing a delay-time difference between outputs of speakers in an audio system is described in Japanese Unexamined Patent Application Publication No. 10-248098. An acoustic processing system disclosed therein has delay units provided for respective speakers for delaying audio signals to be sent to the speakers. Upon receiving the designation of an audio-sound listening position from a user, the acoustic processing system sets delay times for the respective delay units so that the sound image is localized ahead of the received listening position, in accordance with the relationship between a preset listening position and delay times for audio signals sent to the respective speakers.

According to the known technology, the delay times for the audio signals to be sent to the respective speakers are controlled based on a listening position designated by the user and the relationship between the pre-set listening position and the delay times of audio signals to be sent to the respective speakers. However, with such control, in some cases, the sound image cannot be correctly localized to a position desired by the user, depending on the in-vehicle environment. In such a case, the user needs to perform complicated work, i.e., checking the localization position of audio sound produced by the speakers while gradually varying the designated listening position in a trial and error manner, until the output audio sound is localized to a desired position.

SUMMARY OF THE INVENTION

Accordingly, it is an object of the present invention to provide an audio system that allows a user to easily localize the audio image of audio sound, produced from multiple speakers, to his or her desired position.

In order to achieve the foregoing object, the present invention provides an audio system including: a plurality of speakers for producing audio sound; an audio source apparatus for sending, to the respective speakers, audio signals expressing the audio sound to be produced from the speakers; and delay units for providing a delay-time difference between the audio signals sent from the audio source apparatus to the respective speakers. The audio system further includes: a storage unit that stores relationship information indicating a relationship between a localization position of a sound image of audio sound produced from the speakers and a delay-time difference between audio signals sent to the respective speakers; and a localization-position setting reception section for receiving, from a user, a setting of a desired localization position of a sound image of the audio sound produced from the speakers. The audio system further includes a delay-time difference controller for causing the delay units to provide a delay-time difference between the audio signals sent to the respective speakers so that the sound image of the audio sound is localized to the localization position whose setting was received by the localization-position setting reception section. The delay-time difference is determined in accordance with the relationship indicated by the relationship information stored in the storage unit. The audio system further includes a localization-position input reception section for receiving, from the user, an input of a localization position of a sound image of audio sound produced from the speakers and aurally perceived by the user; and a relationship-information modifying section for modifying the relationship, indicated by the relationship information stored in the storage unit, so as to correspond to an association between the localization position whose input was received by the localization-position input reception section and a delay-time difference that the delay units provide between the audio signals sent to the respective speakers when the user aurally perceived the localization position.

According to the audio system, the relationship information that is used for determining a delay-time difference for localizing a sound image to a set localization position can be automatically modified so as to correspond to an association between a delay-time difference determined so that the sound image is localized to a localization position set by the user and the localization position of a sound image aurally perceived by the user with respect to audio-sound outputs based on the delay-time difference. In accordance with the modified relationship information, the delay-time difference is modified so that the sound image is localized to the set localization position. Thus, the relationship information can be modified so as to more correctly express the relationship between the delay-time difference and the localization position of a sound image aurally perceived by the user, so that the sound image can be more accurately localized to a localization position set by the user. In this case, it is sufficient for the user to merely designate the localization position of the sound image of audio sound produced from multiple speakers and aurally perceived by him or her. As a result, the user can easily localize the sound image of audio sound, produced from the speakers, to a desired position.

In order to achieve the foregoing object, the present invention provides an audio system including: a plurality of speakers for producing audio sound; an audio source apparatus for sending, to the respective speakers, audio signals expressing the audio sound to be produced from the speakers; and delay units for providing a delay-time difference between the audio signals sent from the audio source apparatus to the respective speakers. The audio system further includes: a storage unit that stores relationship information indicating a relationship between a localization position of a sound image of audio sound produced from the speakers and a delay-time difference between audio signals sent to the respective speakers; and a localization-position setting reception section for receiving, from a user, a setting of a desired localization position of a sound image of the audio sound produced from the speakers. The audio system further includes a delay-time difference controller for causing the delay units to provide a delay-time difference between the audio signals sent to the respective speakers so that the sound image of the audio sound is localized to the localization position whose setting was received by the localization-position setting reception section. The delay-time difference is determined in accordance with the relationship indicated by the relationship information stored in the storage unit. The audio system further includes a relationship-information calibrating section. While changing the delay-time difference that the delay units provides between the audio signals sent to the respective speakers, the relationship-information calibrating section receives, from the user, an input of each localization position of a sound image of audio sound produced from the speakers and aurally perceived by the user, and modifies the relationship, indicated by the relationship information stored in the storage unit, so as to correspond to an association between each localization position whose input was received and a corresponding delay-time difference that the delay units provided between the audio signals sent to the respective speakers when the user aurally perceived the localization position.

According to the audio system, the relationship information that is used for determining a delay-time difference for localizing a sound image to a set localization position can be automatically modified so as to correspond to an association between each delay-time difference and a localization position of a sound image aurally perceived by the user with respect to audio-sound outputs based on the corresponding delay-time difference. Thus, the relationship information can be modified so as to more correctly express the relationship between the delay-time difference and the localization position of a sound image aurally perceived by the user, so that the sound image can be more accurately localized to a localization position set by the user. In this case, it is sufficient for the user to merely designate the localization position of the sound image of audio sound produced from multiple speakers and aurally perceived by him or her. As a result, the user can easily localize the sound image of audio sound, produced from the speakers, to a desired position.

The audio system may further include a display device and a position input device. The display device displays a layout image showing a layout of a listening space of the audio sound. An input of a position on the displayed layout image is received through the position input device, and a position in the listening space which corresponds to an on-layout-image position whose input was received is used as a localization position whose setting and input are to be received.

The audio system may be installed in a vehicle. In this case, the layout image may be an image showing a layout obtained by viewing a dashboard of the vehicle and the vicinity of the dashboard from the inside of the vehicle, and a vehicle left-and-right-direction position corresponding to an on-layout-image left-and-right direction position whose input was received may be designated as a vehicle left-and-right direction localization position whose setting and input are to be received. Alternatively, the layout image may be an image showing a layout obtained by viewing a dashboard of the vehicle and the vicinity of the dashboard from the inside of the vehicle, and a vehicle left-and-right and up-and-down direction position corresponding to an on-layout-image left-and-right and up-and-down direction position whose input was received may be used as a vehicle left-and-right and up-and-down direction localization position whose setting and input are to be received. Alternatively, the layout image may be an image showing an in-vehicle horizontal layout, and a vehicle left-and-right and front-and-rear direction position corresponding to an on-layout-image left-and-right and up-and-down direction position whose input was received may be used as a vehicle left-and-right and front-and rear direction localization position whose setting and input are to be received.

Preferably, the position input device in the audio system is a touch panel arranged on a display surface of the display device.

As described above, according to the present invention, the user can easily localize the sound image of audio sound, produced from multiple speakers, to a desired position.

DESCRIPTION OF THE PREFERRED EMBODIMENT

An embodiment of the present invention will now be described in the context of a vehicle audio system by way of example.

Figure 1:
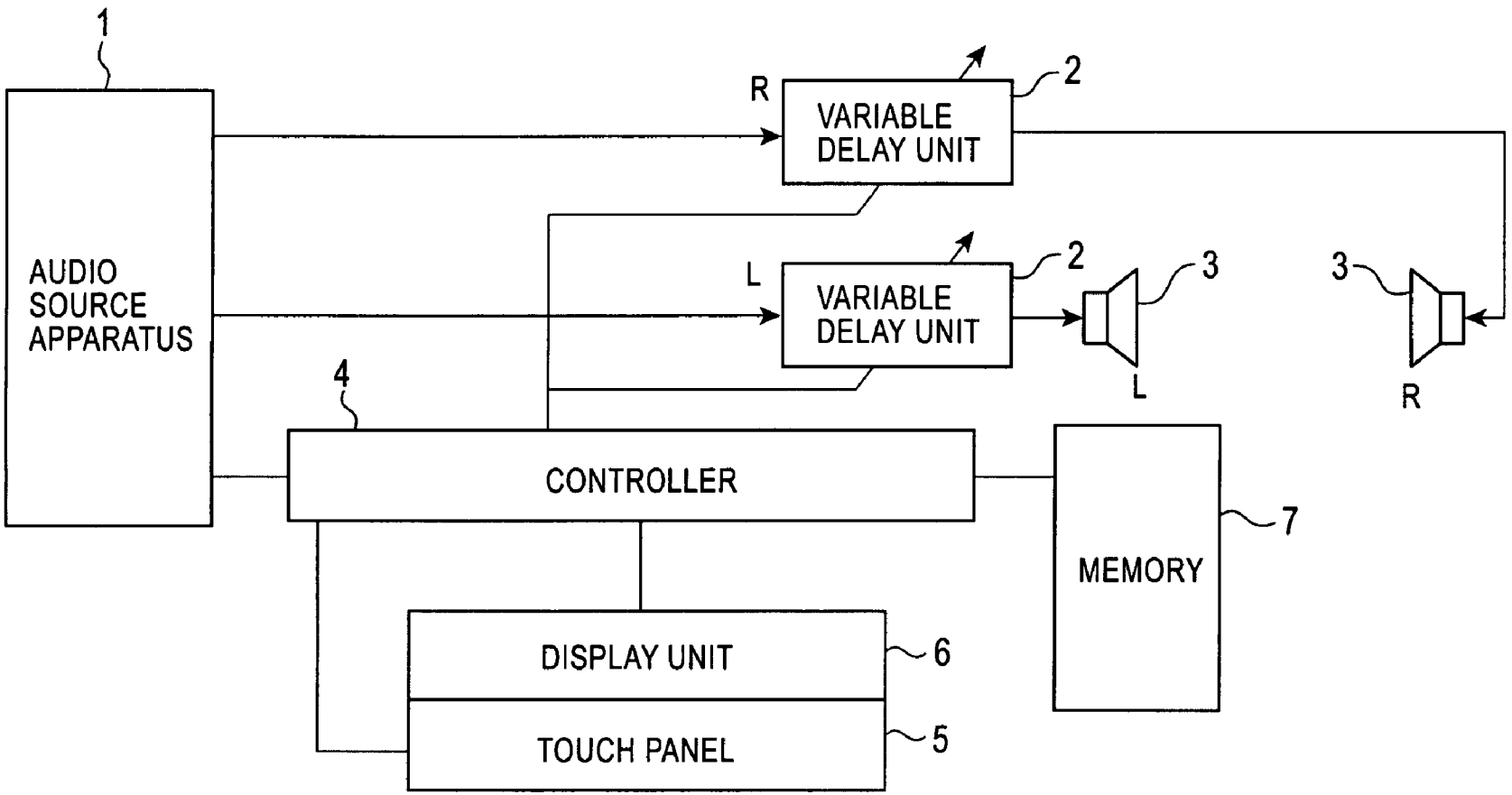
FIG. 1 is a block diagram showing the general configuration of an audio system according to an embodiment of the present invention.

FIG. 1 shows the general configuration of an audio system according to an embodiment of the present invention.

As shown, the audio system includes an audio source apparatus 1, variable delay units 2 and speakers 3 provided for respective channels, a controller 4, a touch panel 5 serving as an input device, a display unit 6, and a memory 7.

The audio source apparatus 1 includes, for example, a CD-DA player, an MD player, a DVD-Audio player, and/or a radio broadcast tuner, and produces audio signals for listening by the user. The touch panel 5 is arranged on the display screen of the display unit 6.

The audio system has a left channel and a right channel. The left-channel variable delay unit 2 delays, by a preset amount of delay time, left-channel audio signals supplied from the audio source apparatus 1 to the left-channel speaker 3 (indicated by L), and the right-channel variable delay unit 2 delays, by a preset amount of delay time, right-channel audio signals supplied from the audio source apparatus 1 to the right-channel speaker 3 (indicated by R). The memory 7 stores a localization-position-delay-time difference table that defines the relationship between a sound-image localization position and a time difference between the right-channel delay time and the left-channel delay time.

With this configuration, the controller 4 provides a user with various GUIs (graphical user interfaces) by using the display unit 6 and the touch panel 5 and controls the operation of each unit described above in accordance with user instructions that the user enters through the touch panel 5 on the GUIs.

That is, in accordance with the user instructions entered through the touch panel 5 on the GUIs, the controller 4 controls various operations, such as a sound-volume adjustment operation of the audio source apparatus 1. For example, when the audio source apparatus 1 is a CD-DA player, MD player, DVD-Audio player, or the like, the controller 4 controls various playback operations (such as playback start, stop, and playback skip). When the audio source apparatus 1 is a radio broadcast receiver, the controller 4 controls its reception operation (e.g., broadcast reception channel switching).

Upon receiving a localization-position setting instruction given by the user through the touch panel 5 on the GUI, the controller 4 performs localization-position setting processing.

Figure 2:
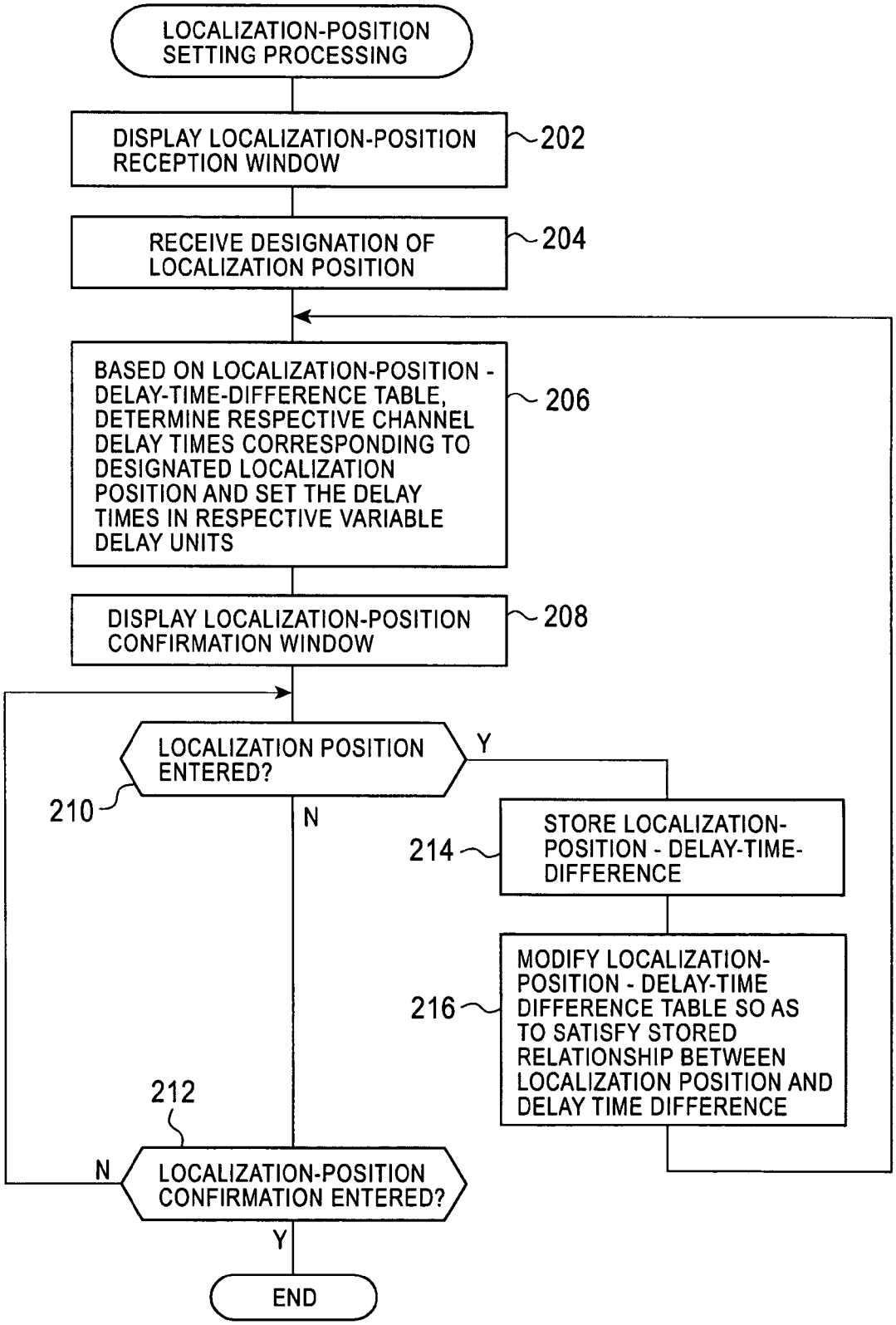
FIG. 2 is a flow chart showing localization-position setting processing performed by the audio system of the embodiment of the present invention.

FIG. 2 shows the procedure of the localization-position setting processing.

Figure 3:
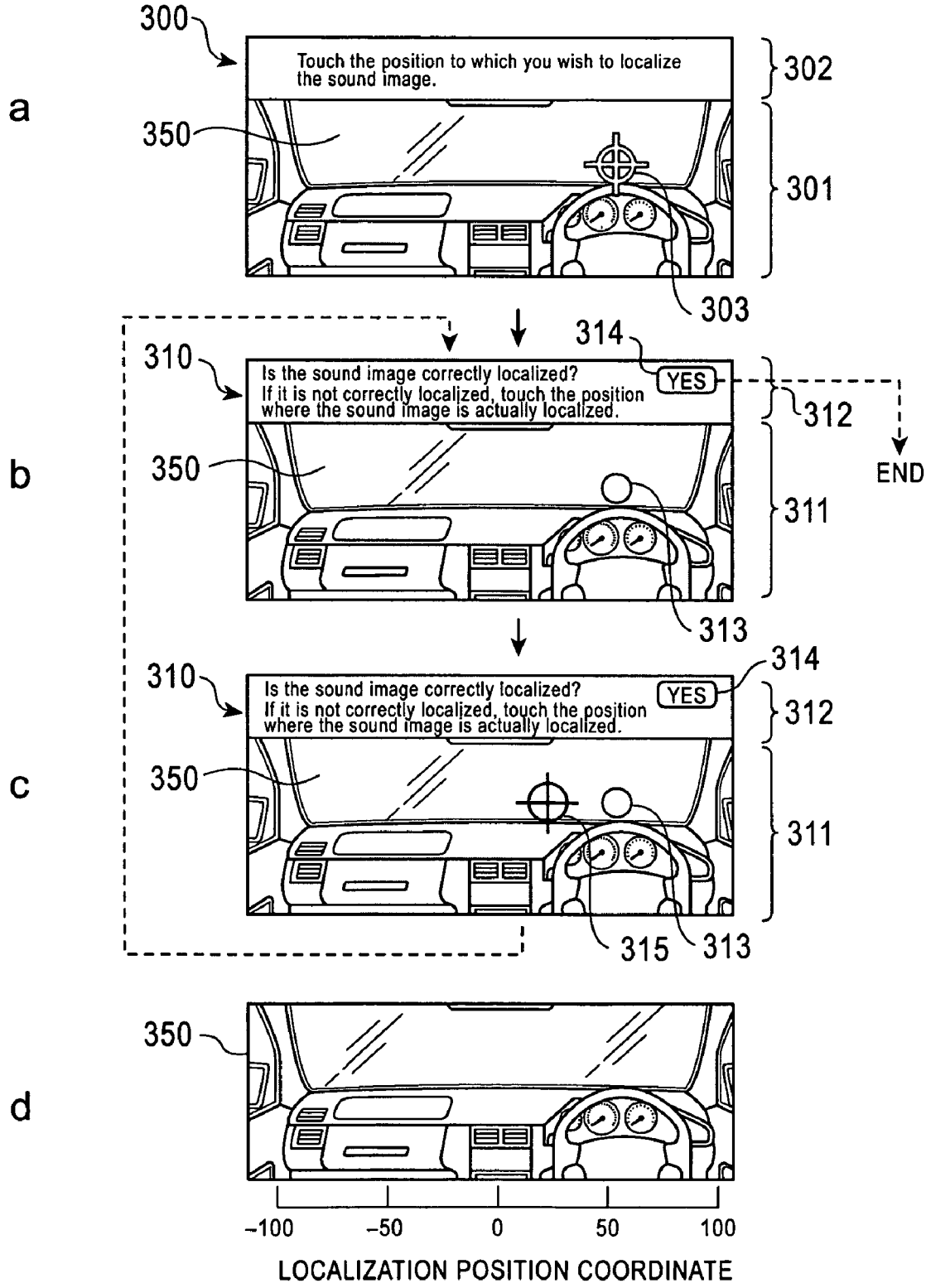
FIG. 3 is a view showing examples of a display screen for use in the localization-position setting processing performed by the audio system of the embodiment of the present invention.

As shown, in this processing, first, a localization-position reception window is displayed on the display unit 6 in step 202. Part a in FIG. 3 shows a localization-position reception window 300. As shown, the localization-position reception window 300 has a localization-position designation reception area 301 and a message area 302. The localization-position designation reception area 301 shows a dashboard image 350 representing a dashboard. The message area 302 displays a message for prompting the user to touch a position on the touch panel 5, the position corresponding to a position that exists on the dashboard image 350 and that corresponds to a desired localization position.

When the localization-position reception window 300 is displayed in step 202 in FIG. 2, the designation of a localization position is received in step 204, in response to the user touching the touch panel 5. As shown in part d in FIG. 3, a localization-position coordinate that increases from −100 to 100 from left to right with the center of the dashboard being 0 is provided so as to correspond to the left-and-right direction coordinate of the dash board image 350. In step 204, a localization-position coordinate corresponding to the left-and-right direction coordinate of the dashboard image 350, the localization-position coordinate corresponding to the position that the user touched on the touch panel 5, is received as the designation of a localization position. Reference numeral 303 shown in part a in FIG. 3 indicates a cursor displayed to indicate the spot touched by the user.

Figure 4A:
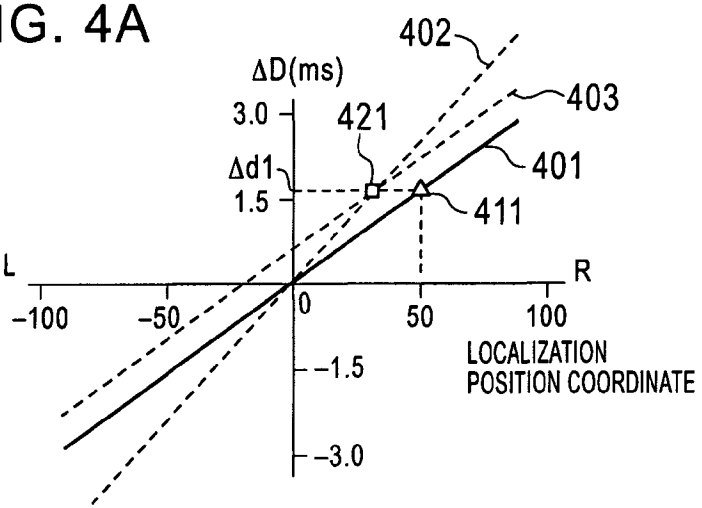
FIGS. 4A to 4D are graphs showing examples of operation in delay time setting processing performed by the audio system of the embodiment of the present invention.

When the designation of the localization position is received in step 204 in FIG. 2, the localization-position reception window 300 is closed. In step 206, in accordance with the relationship shown in the localization-position-delay-time difference table stored in the memory 7, the right-channel delay time and the left-channel delay time are determined so as to satisfy a time difference between the right-channel delay time and the left-channel delay time, the time difference being defined with respect to the designated localization position. Further, the right-channel delay time and the left-channel delay time are set in the right-channel variable delay unit 2 and the left-channel variable delay unit 2, respectively. A solid line 401 shown in FIG. 4A represents a localization-position-delay-time difference curve showing, in a localization-position-delay-time difference space, the relationship between the localization position coordinate and a delay-time difference ΔD between the right-channel delay time and the left-channel delay time, the relationship being shown by the localization-position-delay-time difference table. The localization-position-delay-time difference space is a space defined by a coordinate axis representing the localization-position coordinate and a coordinate axis representing the time difference ΔD between the right-channel delay time and the left-channel delay time. The localization-position-delay-time difference table showing the localization-position-delay-time difference curve 401 may be stored in the memory 7. In step 206, for example, when the designation of localization-position coordinate "50" is received as the localization position, the delay times are set so that value Δd1 of the time difference ΔD for a point 411 indicated by a triangle in FIG. 4A becomes the time difference between the delay time of the right-channel variable delay unit 2 and the delay time of the left-channel variable delay unit 2 and so that the largest amount of delay time to be set is minimized.

When the delay times are set in the respective variable delay units 2 in step 206 in FIG. 2, a localization-position confirmation window is displayed on the display unit 6 in step 208.

As shown in part b in FIG. 3, a localization-position confirmation window 310 has a message area 312 and a localization-position reception area 311 showing the dashboard image 350. A mark 313 indicating a previously designated localization position is shown on the dashboard image 350. The message area 312 shows a message for querying whether or not a sound image is localized at a desired localization position. When the sound image is not localized at a desired localization position, the message area 312 shows a message for prompting the user to touch a position on the touch panel 5, the position corresponding to a position that exists on the dashboard image 350 and that corresponds to the position where the sound image is currently localized. The message area 312 further has a "YES" button 314 for receiving a confirmation indicating that the sound image is localized at the desired localization position.

When the localization-position confirmation window 310 is displayed in step 208 in FIG. 2, a determination is made in step 210 as to whether the user has entered a localization position by touching the touch panel 5, and a determination is made in step 212 as to whether or not the user has confirmed the localization position by pressing the "YES" button 314.

As shown in part c in FIG. 3, when the user enters a localization position by touching the touch panel 5, a localization-position coordinate corresponding to the left-and-right coordinate of the dashboard image 350 which corresponds to the spot that the user touched on the touch panel 5 is received as the designation of a confirmation localization position. Reference numeral 315 shown in part c in FIG. 3 indicates a cursor displayed to indicate the spot touched by the user.

In step 214, an association between the localization-position coordinate received as the confirmation localization position and the time difference Δd between the delay time currently set in the right-channel variable delay unit 2 and the delay time currently set in the left-channel variable delay unit 2 is stored as user confirmation localization information. In step 216, the localization-position-delay-time difference table stored in the memory 7 is modified so as to satisfy the relationship between the localization-position coordinate indicated by each piece of the previously stored user confirmation localization position information and the time difference between the delay time currently set in the right-channel variable delay unit 2 and the delay time currently set in the left-channel variable delay unit 2. Thereafter, the processing from step 206 is repeated.

The localization-position-delay-time difference table is modified in step 216, for example, as follows.

First, when the number of pieces of the previously-stored user confirmation localization information is only one, the modification is performed as follows. It is now assumed that, with respect to the setting of the delay times of the variable delay units 2 which satisfies the value Δd1 of the delay-time difference ΔD for the triangle point 411 shown in FIG. 4A, the delay-time difference Δd and the localization position, shown by the user confirmation localization information stored in accordance with the designation of the user confirmation localization position, indicate a square point 421 in the localization-position-delay-time difference space. In this case, the slope of the localization-position-delay-time difference curve 401 shown in the localization-position-delay-time difference table is increased or decreased in the vertical direction (i.e., in the direction of the delay-time difference ΔD) with ΔD=0 being the center of the curve 401 so that the square point 421 is located on the localization-position-delay-time difference curve to thereby determine a new localization-position-delay-time difference curve 402, and the localization-position-delay-time difference table is modified so as to express the determined localization-position-delay-time difference curve 402. However, the localization-position-delay-time difference curve 401 may be offset in the direction of the delay-time difference ΔD so that the square point 421 is located on the localization-position-delay-time difference curve in the localization-position-delay-time difference space, to thereby determine a new localization-position-delay-time difference curve 403.

Figure 4B:
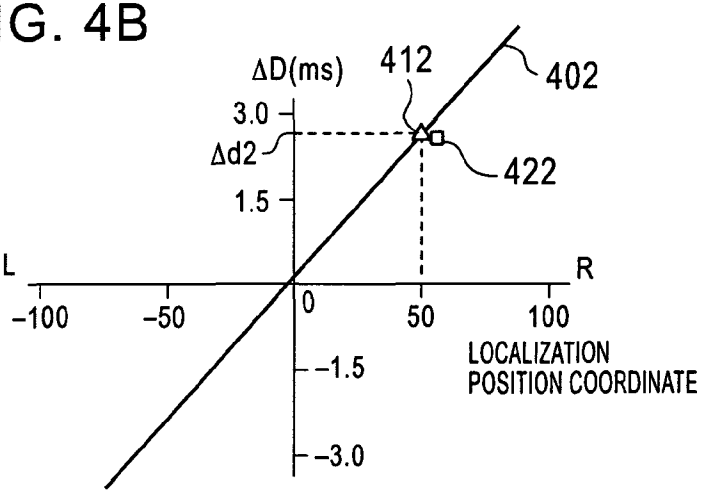
Figure 4C:
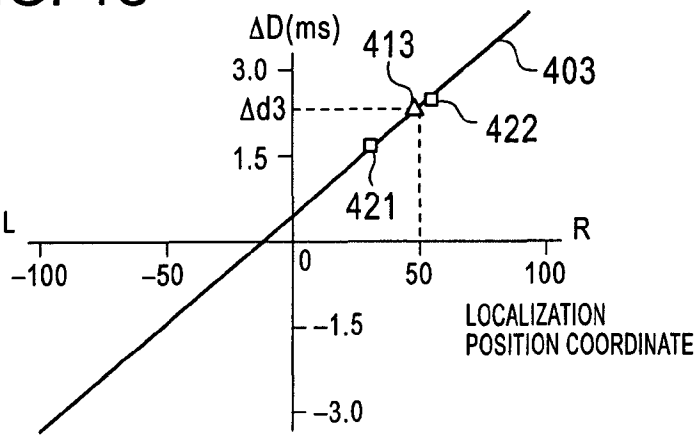

When multiple pieces of user confirmation localization information are stored, the modification is performed as follows. That is, for example, as shown in FIG. 4A, when the localization-position-delay-time difference curve 401 is modified to the localization-position delay-time difference curve 402 by increasing the slope of the localization-position-delay-time difference curve 401 in the direction of the delay-time difference ΔD, the delay times are set in the respective variable delay units 2 in accordance with the localization-position delay-time difference curve 402 after the modification, as shown in FIG. 4B, so as to satisfy value Δd2 of the delay-time difference ΔD for a triangle point 412 corresponding to localization position coordinate "50" of the localization position designated by the user. When the delay-time difference ΔD and the localization position indicated by the user confirmation localization information stored in accordance with the designation of a confirmation localization position by the user indicates a square point 422 in the localization-position-delay-time difference space with respect to the setting of the delay times of the variable delay units 2, the localization-position-delay-time difference table is modified so that a curve that smoothly connects the square point 422 and the square point 421, in the localization-position-delay-time-difference space, indicated by the delay-time difference ΔD and the localization position indicated by the previously stored user confirmation localization position becomes a new localization-position-delay-time difference curve 403, as shown in FIG. 4C. This curve is obtained as a spline curve or Bezier curve that passes through the square points 421 and 422. When the number of pieces of the stored user confirmation localization information is only two, the curve becomes straight. In accordance with the modified localization-position-delay-time difference curve 403, delay times are set in the respective variable delay units 2 so as to satisfy value Δd3 of the delay-time difference ΔD for a triangle point 413 corresponding to localization-position coordinate "50" of the localization position designated by the user.

Figure 4D:
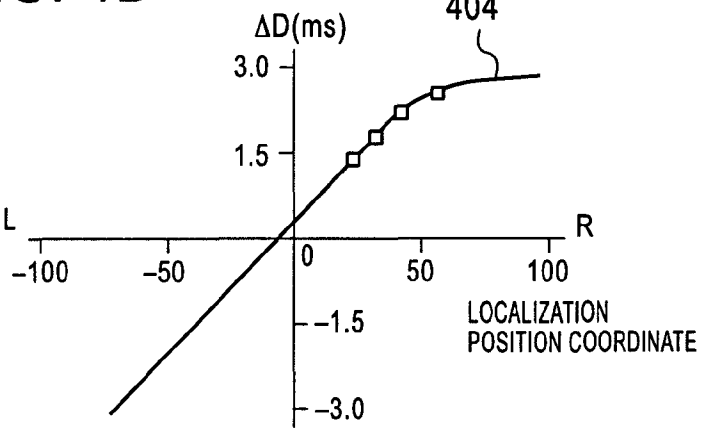

Similarly, while the localization-position-delay-time difference curve is modified, delay times are set in the respective variable delay unit 2 so as to satisfy the value of delay-time difference ΔD for a point on the localization-position-delay-time difference curve, the point corresponding to localization position coordinate "50" of the localization position designated by the user, in accordance with the modified localization-position-delay-time difference curve, until the "YES" button 314 in the localization-position confirmation window 310 is operated. The localization-position-delay-time difference table is modified so that, as shown in FIG. 4D, a curve that smoothly connects square points indicated, in the localization-position-delay-time difference space, by user confirmation localization information stored in accordance with the designation of the user localization confirmation position with respect to the setting and all previously stored user confirmation localization information becomes a new localization-position-delay-time difference curve 404.

Referring back to FIG. 2, after the localization-position confirmation window 310 is displayed in step 208, when the localization position is confirmed by the operation of the "YES" button 314 in step 212, the localization-position confirmation window 310 is closed and the processing is finished.

The localization-position setting processing performed by the controller 4 has been described above.

According to the localization-position setting processing, the localization-position-delay-time difference table that is used for determining a delay-time difference for localizing a sound image at a designated localization position is automatically modified so as to correspond to the relationship between a delay-time difference determined so that a sound image is localized at a localization position designated by the user and the localization position of a sound image aurally perceived by the user with respect to audio-sound outputs based on the delay-time difference. Further, in accordance with the modified localization-position-delay-time difference table, the delay-time difference is modified so that the sound image is localized to the designated position. Thus, the localization-position-delay-time difference table can be modified so as to more correctly express the relationship between the delay-time difference and the localization position of a sound image aurally perceived by the user, so that the sound image can be more accurately localized to the localization position designated by the user. In this case, it is sufficient for the user to merely designate, on the dashboard image 350, the localization position of the sound image of audio sound aurally perceived by him or her. As a result, the user can easily localize the sound image of audio sound, produced from the multiple speakers 3, to a desired position.

Figure 5:
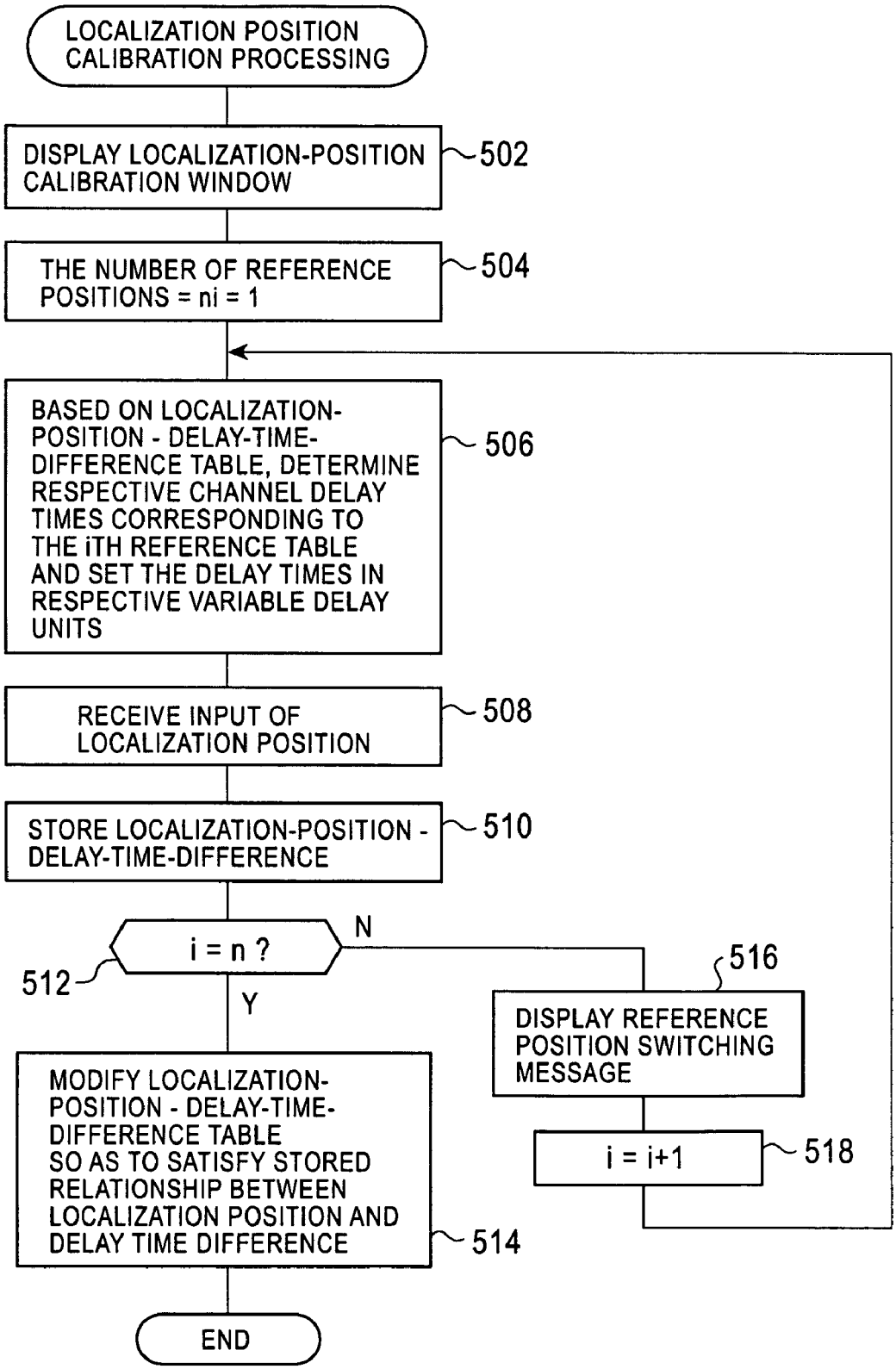
FIG. 5 is a flow chart showing localization-position calibration processing performed by the audio system of the embodiment of the present invention.

Next, localization-position calibration processing performed by the controller 4 will be described. FIG. 5 shows the procedure of the localization-position calibration processing.

In this processing, a localization-position calibration window is first displayed on the display unit 6 in step 502. As shown in part a in FIG. 6, the localization-position calibration window 600 includes a message area 602 and a localization-position reception area 601 showing the dashboard image 350. The message area 602 shows a message notifying the user about the start of calibrating a localization position.

In the present embodiment, predetermined multiple localization positions are preset as reference positions. For example, as shown in part d in FIG. 6, localization positions #1 to #9 having nine different localization-position coordinates are preset from right to left as reference positions.

When the localization-position calibration window 600 is displayed in step 502 in FIG. 5, the following processing (steps 504, 512, and 516) is performed on each reference position. That is, in step 506, the right-channel delay time and the left-channel delay time are determined so as to satisfy the value of a delay-time difference ΔD for a point corresponding to the localization position coordinate of each reference position on the localization-position-delay-time difference curve indicated by the localization-position-delay-time difference table, and the determined delay times are set in the respective variable delay units 2.

Figure 6:
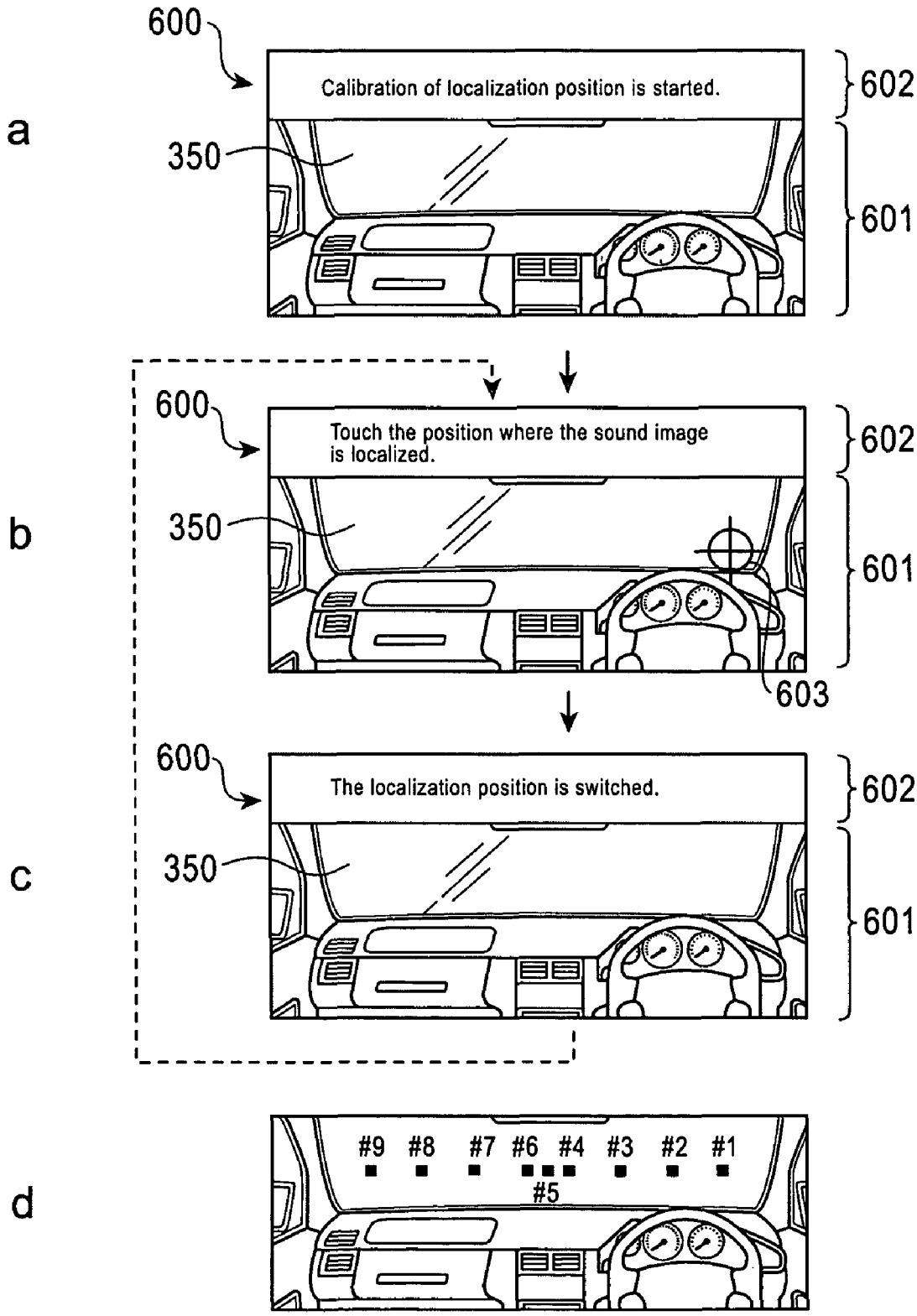
FIG. 6 is a view showing examples of a display screen for use in the localization-position calibration processing performed by the audio system of the embodiment of the present invention.

As shown in part b in FIG. 6, the message in the message area 602 in the localization-position calibration window 600 is changed to a message for prompting the user to touch a spot on the touch panel 5, the spot corresponding to a position that exists on the dashboard image 350 and that corresponds to the position where the sound image is localized. In step 508, the localization position coordinate corresponding to the left-and-right direction coordinate of the dashboard image 350, the left-and-right direction coordinate corresponding to the spot the user touched on the touch panel 5, is received as the designation of the confirmation localization position. Reference numeral 603 in part b shown in FIG. 6 indicates a cursor displayed to indicate the spot touched by the user.

In step 510, an association between the localization position coordinate received as the confirmation localization position and the time difference ΔD d between the delay time currently set in the right-channel variable delay unit 2 and the delay time currently set in the left-channel variable delay unit 2 is stored as user confirmation localization information.

Subsequently, in step 512, a determination is made as to whether or not processing in steps 506 to 510 is completed with respect to all the reference positions. When the processing is not completed, in step 516 the message in the message area 602 in the localization-position calibration window 600 is changed to a message indicating the switching of the reference position, as shown in part c in FIG. 6, and the processing in steps 506 to 510 is performed on a next reference position.

On the other hand, when the processing in steps 506 to 510 is completed with respect to all of the reference positions, the localization-position-delay-time difference table stored in the memory 7 is modified in step 514 so as to satisfy the relationship between the localization-position coordinate indicated by each piece of the previously stored user confirmation localization information and the time difference between the delay time currently set in the right-channel variable delay unit 2 and the delay time currently set in the left-channel variable delay unit 2. The processing is then finished.

Figure 7A:
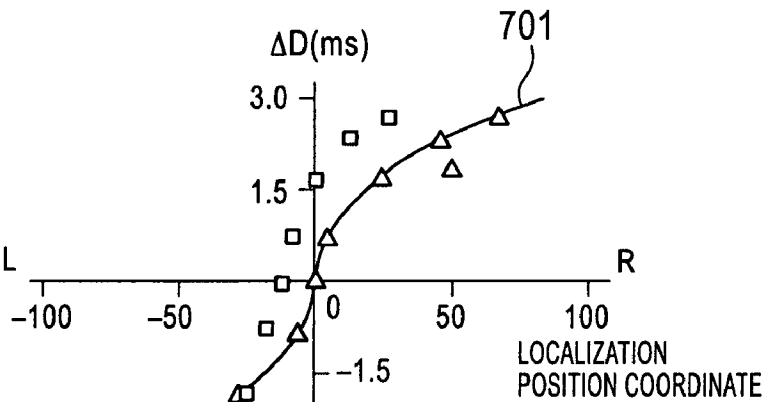
FIGS. 7A and 7B are graphs showing examples of operation in delay-time calibration processing performed by the audio system of the embodiment of the present invention.
Figure 7B:
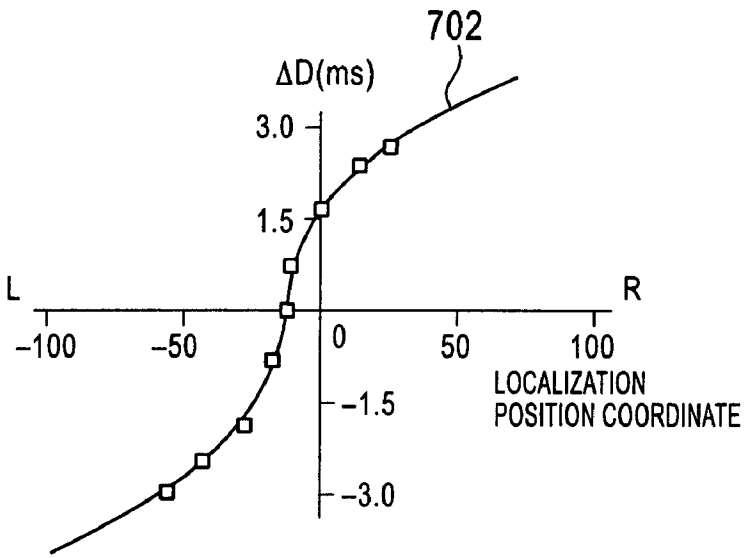

According to the localization-position calibration processing described above, for example, during the start of the processing, when the localization-position-delay-time difference table showing the localization-position-delay-time difference curve 701 shown in FIG. 7A is stored in the memory 7, the values of the delay-time differences ΔD for illustrated triangle points corresponding to respective reference positions are sequentially selected and delay times are set in the variable delay units 2 for the respective channels so that the value of the selected delay-time difference ΔD becomes the time difference between the delay time of the right-channel variable delay unit 2 and the delay time of the left-channel variable delay unit 2 and so that the largest amount of delay time set in one of the variable delay units 2 is minimized. When user confirmation localization positions are designated for respective settings, multiple pieces of the user confirmation localization information indicating the square points in the localization-position-delay-time difference space are sequentially stored. Lastly, as shown in FIG. 7B, the localization-position-delay-time difference table is modified so that a curve that smoothly connects the square points, in the localization-position-delay-time difference space, indicated by all pieces of the previously-stored user confirmation localization information becomes a new localization-position-delay-time-difference curve 702.

The localization-position calibration processing performed by the controller 4 has been described above.

According to the localization-position calibration processing, the localization-position-delay-time difference table that is used for determining a delay-time difference for localizing a sound image to a designated localization position can be automatically modified so as to correspond to the association between a delay-time difference for each reference position and the localization position of a sound image aurally perceived by the user with respect to audio-sound outputs based on the delay-time difference. Thus, the localization-position-delay-time difference table can be modified so as to more correctly express the relationship between the delay-time difference and the localization position of a sound image aurally perceived by the user, so that the sound image can be more accurately localized to a localization position designated by the user. In this case, it is sufficient for the user to merely designate, on the dashboard image 350, the localization position of the sound image of audio sound produced from the multiple speakers and aurally perceived by him or her, multiple times. As a result, the user can easily localize the sound image of audio sound, produced from the speakers 3, to a desired position.

The description above has been given of a case in which the audio system has two channels, i.e., the left channel and the right channel, and two speakers 3, i.e., one for the left channel and one for the right channel, and sets and calibrates the localization position only in the left-and-right direction. However, in the present embodiment, the audio system may have three or more speakers 3, which produce audio sound expressed by audio signals supplied from the audio source apparatus 1, and variable delay units 2 provided for the respective speakers 3 to delay the audio signals. In such a case, the present invention is similarly applicable to a case in which the localization position can be set and calibrated not only in the left-and-right direction but also in the up-and-down direction and/or in the front-and-rear direction.

For example, when a localization position in both the left-and-right direction and the up-and-down direction is set and/or calibrated, a time difference between the delay time that one variable delay unit 2 gives to an audio signal supplied to a corresponding reference speaker 3 and the delay time that another variable delay unit 2 gives to an audio signal supplied to a corresponding speaker 3 is defined, with respect to each combination of a localization position in the left-and-right direction and a localization position in the up-and-right direction, in the localization-position-delay-time difference table stored in the memory 7. The coordinates of the localization position set in the left-and-right direction and the up-and-down direction are received in accordance with the left-and-right-direction coordinate and the up-and-down-direction coordinate of a spot touched on the dashboard 350 in the localization-position reception window 300 or the localization-position confirmation window 310 shown in FIG. 3 or the localization-position calibration window 600 shown in FIG. 6.

Figure 8:
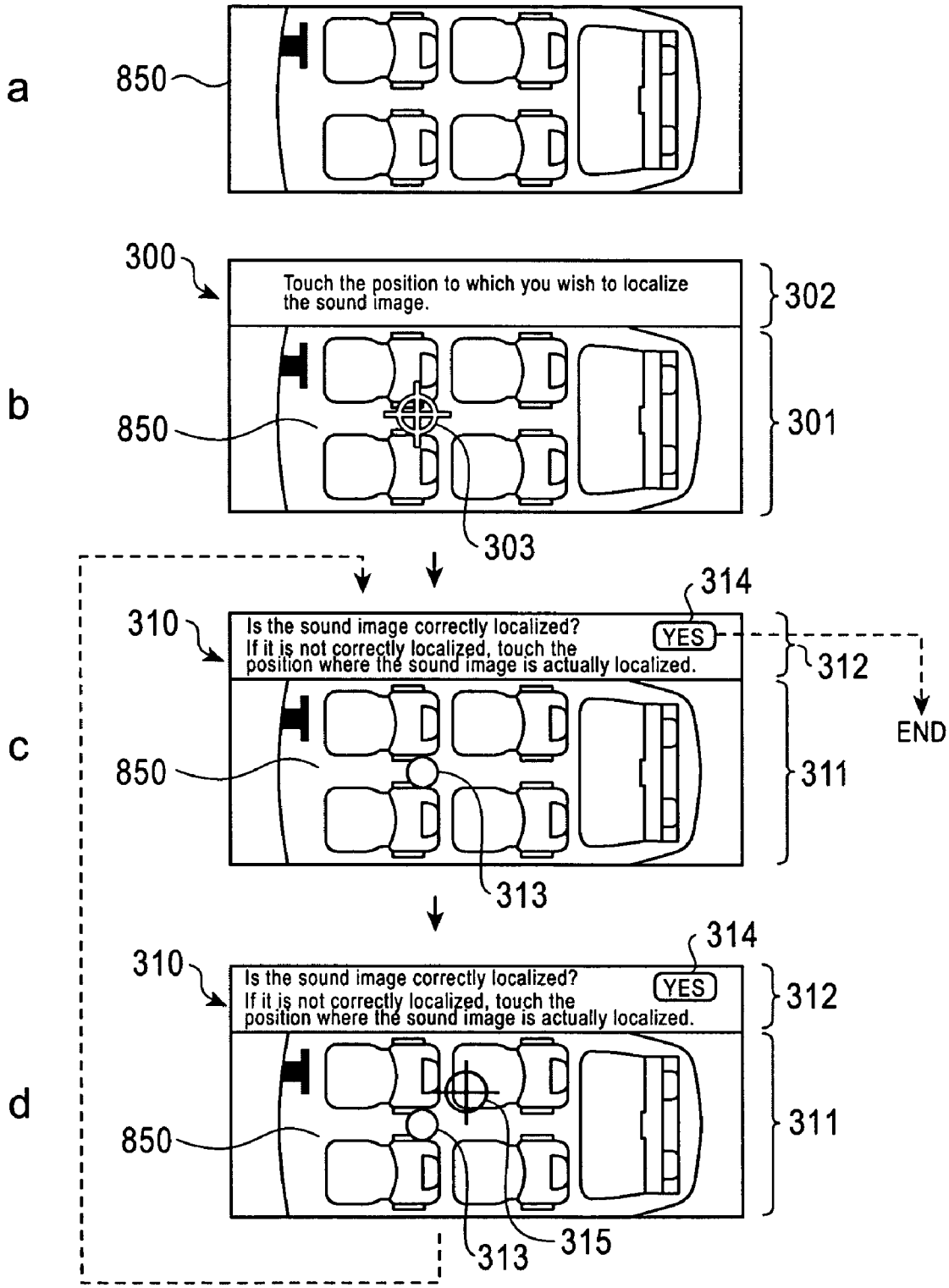
FIG. 8 is a view showing examples of the display screen for use in the localization-position setting processing performed by the audio system of the embodiment of the present invention.

For example, when a localization position in the left-and-right direction and the front-and-rear direction is set and/or calibrated, a time difference between the delay time that one variable delay unit 2 gives to an audio signal supplied to a corresponding reference speaker 3 and the delay time that another variable delay unit 2 gives to an audio signal supplied to a corresponding speaker 3 is defined, with respect to each combination of a localization position in the left-and-right direction and a localization position in the front-and-rear direction, in the localization-position-delay-time difference table stored in the memory 7. Instead of the dashboard image 350, an in-vehicle layout image 850 shown in part a in FIG. 8 is displayed in the localization-position reception window 300 or the localization-position confirmation window 310 shown in FIG. 3 or the localization-position calibration window 600 shown in FIG. 6. The in-vehicle layout image 850 shows an in-vehicle horizontal layout, with the left side being the front of the vehicle. As shown in the examples of the localization-position reception window 300 and the localization-position confirmation window 310 shown in parts b, c, and d in FIG. 8, the coordinates of the setting of the localization position in the front-and-rear direction and the left-and-right direction are received in accordance with the left-and-right-direction coordinate and the up-and-down-direction coordinate of a spot touched on the in-vehicle layout image 350.

Figure 9:
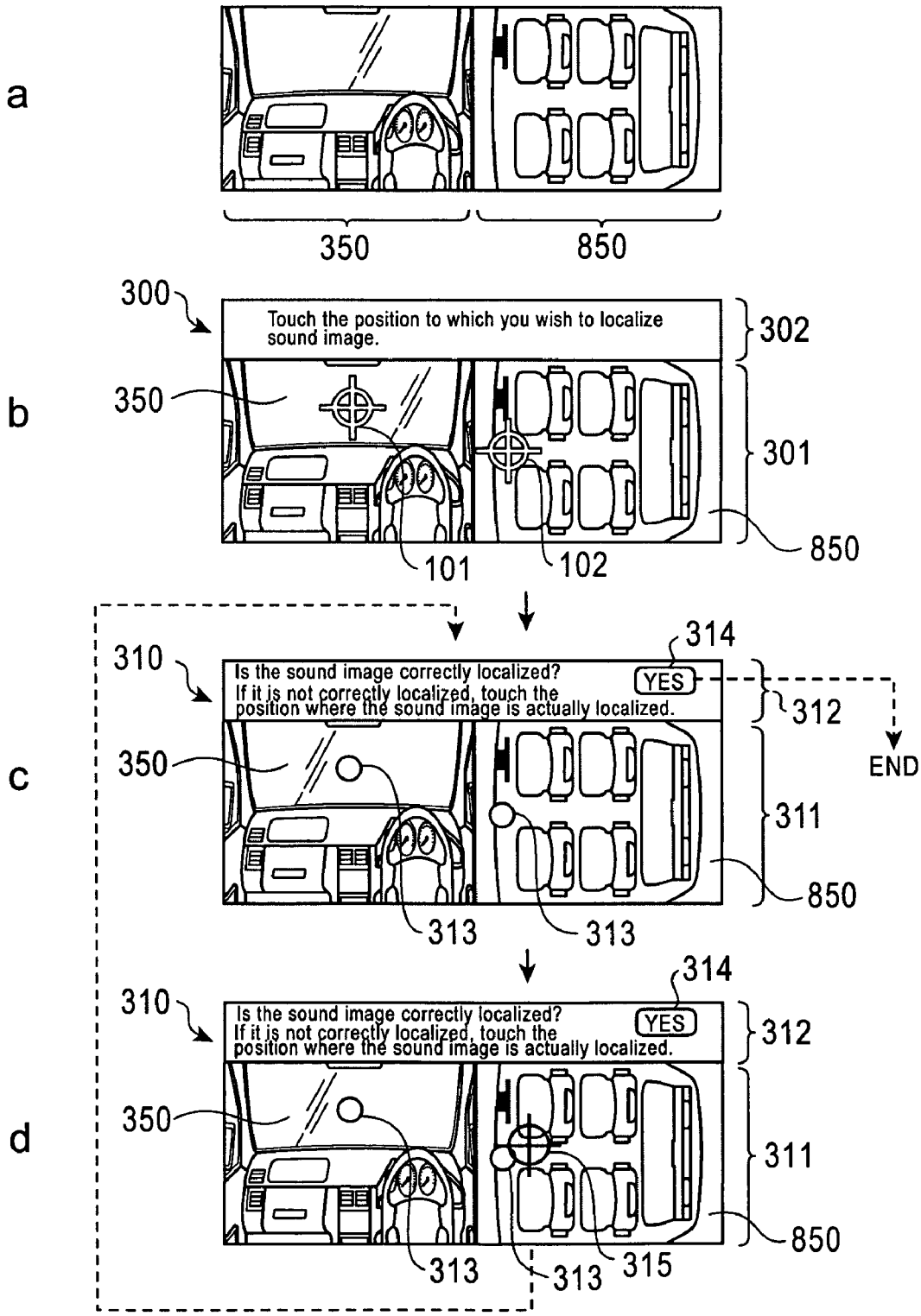
FIG. 9 is a view showing examples of the display screen for use in the localization-position setting processing performed by the audio system of the embodiment of the present invention.

For example, when a localization position in the left-and-right direction, the front-and-rear direction, and the up-and-down direction is set and/or calibrated, a time difference between the delay time that one variable delay unit 2 gives to an audio signal supplied to a corresponding reference speaker 3 and the delay time that another variable delay unit 2 gives to an audio signal supplied to a corresponding speaker 3 is defined, with respect to each combination of a localization position in the left-and-right direction, a localization position in the front-and-rear direction, and a localization position in the up-and-down direction, in the localization-position-delay-time difference table stored in the memory 7. As shown in part a in FIG. 9, instead of the dashboard image 350, a combination image of the dash-board image 350 and the in-vehicle layout image 850 is displayed in the localization-position reception window 300 or the localization-position confirmation window 310 shown in FIG. 3 or the localization-position calibration window 600 shown in FIG. 6. As shown in the examples of the localization-position reception window 300 and the localization-position confirmation window 310 in parts b, c, and d in FIG. 9 for the localization-position setting processing, two spots, i.e., one spot on the in-vehicle layout image 850 of the combination image, and one spot on the dashboard image 350 thereof, are touched. The coordinate of the setting of the localization position in the front-and-rear direction is received in accordance with the left-and-right-direction coordinate of a spot touched on the in-vehicle layout image 850 of the combination image and the coordinate of the setting of the localization position in the up-and-down direction is received in accordance with the up-and-down-direction coordinate of a spot touched on the dashboard 350 of the combination image. Of the spot touched on the in-vehicle layout image 850 of the combination image and the spot touched on the dashboard image 350 of the combination image, in accordance with a spot touched last time, the coordinate of the setting of the localization position in the left-and-right direction is received. That is, when the spot touched last time is located on the in-vehicle layout image 850 of the combination image, the coordinate of the setting of the localization position in the left-and-right direction is received in accordance with the up-and-down-direction coordinate of the spot touched on the in-vehicle layout image 850. When the spot touched last time is located on the dashboard image 350 of the combination image, the coordinate of the setting of the localization position in the left-and-right direction is received in accordance with the left-and-right-direction coordinate of the spot touched on the dashboard image 350.

In any of the case in which a localization position in the left-and-right direction and the up-and-down direction is set and/or calibrated, the case in which in a localization position in the left-and-right direction and the front-and-rear direction is set and/or calibrated, and the case in which a localization position in the left-and-right direction, the front-and-rear direction, and the up-and-down direction is set and/or calibrated, the localization-position-delay-time difference table stored in the memory 7 is modified so as to correspond to a combination of localization position coordinates entered by the user through the localization-position confirmation window 310 or the localization-position calibration window 600 and delay times currently set in the variable delay units 2 at corresponding time, as in the embodiment described above. However, when a localization position in the left-and-right direction and the up-and-down direction is calibrated, multiple positions at different coordinates in the left-and-right and up-and-down directions are preset as reference positions. When a localization position in the left-and-right direction and the front-and-rear direction is calibrated, multiple positions at different coordinates in the left-and-right and front-and-rear directions are preset as reference positions. When a localization position in the left-and-right direction, the front-and-rear direction, and the up-and-down direction is calibrated, multiple positions at different coordinates in the left-and-right, up-and-down, and front-and-rear directions are preset as reference positions.

In the embodiment described above, the localization-position reception window 300 or the localization-position confirmation window 310 shown in FIG. 3 or the localization-position calibration window 600 shown in FIG. 6 is displayed and the touch panel 5 is used to receive the input of a localization position from the user. However, an input device other than the touch panel 5 may be used to receive the input of a localization position.

Figure 10:
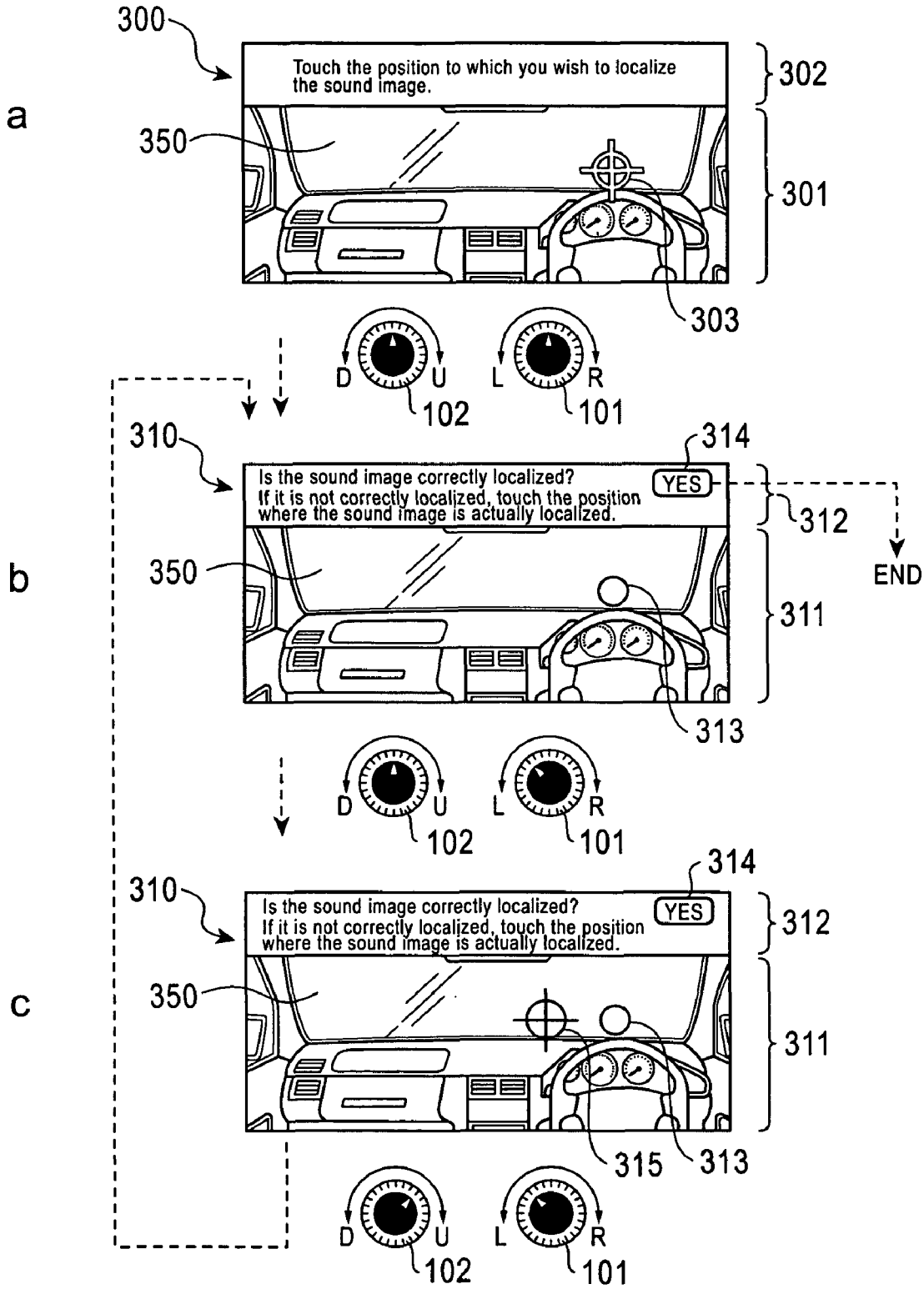
FIG. 10 is a view showing examples of the display screen for use in the localization-position setting processing performed by the audio system of the embodiment of the present invention.

Parts a, b, and c in FIG. 10 show one example in which the audio system is provided with two dial switches 101 and 102 to enter the localization position in the localization-position reception window 300 or the localization-position confirmation window 310 in localization-positing setting processing for setting/calibrating the localization position in the left-and-right direction and in the up-and-down direction. For example, when one dial switch 101 is rotated/operated to move a cursor 303 on the dashboard image 350 in the left-and-right direction and a predetermined execution operation is performed, a coordinate corresponding to the rotation angle of the dial switch 101 is received as a localization-position coordinate in the left-and-right direction. When the other dial switch 102 is rotated/operated to move the cursor 303 on the dashboard image 350 in the up-and-down direction and a predetermined execution operation is performed, a coordinate corresponding to the rotation angle of the dial switch 102 is received as a localization-position coordinate in the up-and-down direction.

The controller 4 may have a CPU (central processing unit) and a memory so as to serve as a computer for performing the above-described various types of processing by executing a predetermined program.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An audio system having a plurality of speakers for producing audio sound; an audio source apparatus for supplying, to the respective speakers, audio signals expressing the audio sound to be produced from the speakers;

and delay units for giving a delay-time difference between the audio signals supplied from the audio source apparatus to the respective speakers, the audio system comprising:

a storage unit that stores relationship information indicating a relationship between a localization position of a sound image of audio sound produced from the speakers and a delay-time difference for audio signals supplied to the respective speakers;

a localization-position setting reception section for receiving, from a user, a setting of a desired localization position of a sound image of the audio sound produced from the speakers;

a delay-time difference controller for causing the delay units to determine the delay-time difference that is applied to the audio signals supplied to the respective speakers so that the sound image of the audio sound is localized to the desired localization position received by the localization-position setting reception section, the delay-time difference being determined in accordance with the relationship indicated by the relationship information stored in the storage unit;

a localization-position input reception section for receiving, from the user, an input of a perceived localization position of a sound image of audio sound that is produced from the speakers and aurally perceived by the user; and a relationship-information modifying section for modifying the relationship indicated by the relationship information stored in the storage unit so as to correspond to an association between the perceived localization position received by the localization-position input reception section and a delay-time difference for the desired localization position determined by the delay units.

2. The audio system according to claim 1, further comprising a display device and a position input device, wherein the localization-position setting reception section causes the display device to display a layout image showing a layout of a listening space of the audio sound, and receive a first input of a position on the displayed layout image through the position input device, wherein a position in the listening space corresponding to the first input of a position on the displayed layout is set as the desired localization position; and wherein the localization-position input reception section causes the display device to display the layout image, and receive a second input of a position on the displayed layout image through the position input device, wherein a position in the listening space corresponding to the second input of a position on the displayed layout is received as the perceived localization position of the sound image of audio sound produced from the speakers and aurally perceived by the user.

3. The audio system according to claim 2, wherein the position input device comprises a touch panel arranged on a display surface of the display device.

4. The audio system according to claim 2, wherein the audio system is installed in a vehicle, wherein the displayed layout image comprises an image showing a layout obtained by viewing a dashboard of the vehicle and the vicinity of the dashboard from the inside of the vehicle, wherein the first input of a position on the displayed layout image is a first input of a vehicle left-and-right-direction position corresponding to a first on-layout-image left-and-right-direction position received by the localization-position setting reception section, the first input of the vehicle left-and-right direction position being a desired left-and-right-direction localization position of the sound image in the vehicle, wherein the second input of a position on the displayed layout image is a second input of a vehicle left-and-right-direction position corresponding to a second on-layout-image left-and-right-direction position received by the localization-position input reception section, the second input of the vehicle left-and-right direction position being a perceived left-and-right-direction localization position of the sound image in the vehicle of audio sound produced from the speakers and aurally perceived by the user, and wherein the delay-time difference controller causes the delay units to determine a delay-time difference based on the relationship indicated by the relationship information stored in the storage unit, the delay-time difference being applied to the audio signals produced from the respective speakers so that the sound image of the audio sound is localized, with respect to the vehicle left-and-right direction, to the desired vehicle left-and-right-direction localization position received by the localization-position setting reception section.

5. The audio system according to claim 2, wherein the audio system is installed in a vehicle, wherein the displayed layout image comprises an image showing a layout obtained by viewing a dashboard of the vehicle and the vicinity of the dashboard from the inside of the vehicle, wherein the first input of a position on the displayed layout image is a first input of a vehicle left-and-right and up-and-down direction position corresponding to a first on-layout-image left-and-right and up-and-down direction position received by the localization-position setting reception section, the first input of the vehicle left-and-right and up-and-down position being a desired left-and-right and up-and-down direction localization position of the sound image in the vehicle, wherein the second input of a position on the displayed layout image is a second input of a vehicle left-and-right and up-and-down direction position corresponding to a second on-layout-image left-and-right and up-and-down direction position received by the localization-position input reception section, the second input of the vehicle left-and-right and up-and-down direction position being a perceived left-and-right and up-and-down direction localization position of a sound image in the vehicle of audio sound produced from the speakers and aurally perceived by the user, and wherein the delay-time difference controller causes the delay units to determine a delay-time difference based on the relationship indicated by the relationship information stored in the storage unit, the delay-time difference being applied to the audio signals produced from the respective speakers so that the sound image of the audio sound is localized, with respect to the vehicle left-and-right and up-and-down direction, to the desired vehicle left-and-right and up-and-down direction localization position received by the localization-position setting reception section.

6. The audio system according to claim 2, wherein the audio system is installed in a vehicle, wherein the displayed layout image comprises an image showing an in-vehicle horizontal layout, wherein the first input of a position on the displayed layout image is a first input of a vehicle left-and-right and front-and-rear direction position corresponding to a first on-layout-image left-and-right and front-and-rear direction position received by the localization-position setting reception section, the first input of the vehicle left-and-right and front-and-rear direction position being a desired left-and-right and front-and-rear direction localization position of the sound image in the vehicle, wherein the second input of a position on the displayed layout image is a second input of a vehicle left-and-right and front-and-rear direction position corresponding to a second on-layout-image left-and-right and front and rear direction position received by the localization-position input reception section, the second input of the vehicle left-and-right and front-and-rear position being a perceived left-and-right and front-and-rear direction localization position of a sound image in the vehicle of audio sound produced from the speakers and aurally perceived by the user, and wherein the delay-time difference controller causes the delay units to determine a delay-time difference based on the relationship indicated by the relationship information stored in the storage unit, the delay-time difference being applied to the audio signals produced from the respective speakers so that the sound image of the audio sound is localized, with respect to the vehicle left-and-right and front-and-rear direction, to the desired vehicle left-and-right and front-and-rear direction localization position received by the localization-position setting reception section.

7. An audio system having a plurality of speakers for producing audio sound; an audio source apparatus for supplying, to the respective speakers, audio signals expressing the audio sound to be produced from the speakers; and delay units for giving a delay-time difference between the audio signals supplied from the audio source apparatus to the respective speakers, the audio system comprising:

a storage unit that stores relationship information indicating a relationship between a localization position of a sound image of audio sound produced from the speakers and a delay-time difference for audio signals supplied to the respective speakers;

a localization-position setting reception section for receiving, from a user, a setting of a desired localization position of a sound image of the audio sound produced from the speakers;

a delay-time difference controller for causing the delay units to determine the delay-time difference between the audio signals to be applied to the respective speakers so that the sound image of the audio sound is localized to the desired localization position received by the localization-position setting reception section, the delay-time difference being determined in accordance with the relationship indicated by the relationship information stored in the storage unit; and a relationship-information calibrating section, wherein, while the delay-time difference determined by the delay units is being changed, the relationship-information calibrating section receives, from the user, an input of at least one perceived localization position of a sound image of audio sound produced from the speakers and aurally perceived by the user, and modifies the relationship indicated by the relationship information stored in the storage unit so as to correspond to an association between each localization position whose input was received and a corresponding delay-time difference determined by the delay units for the audio signals supplied to the respective speakers when the user aurally perceived the localization position.

8. The audio system according to claim 7, further comprising a display device and a position input device, wherein the relationship-information calibrating section causes the display device to display a layout image showing a layout of a listening space of the audio sound and receive an input of a position on the displayed layout image through the position input device, wherein a position in the listening space corresponding to the input of a position on the displayed layout image is received as the at least one perceived localization position of a sound image of audio sound produced from the speakers and aurally perceived by the user.

9. The audio system according to claim 8, wherein the position input device comprises a touch panel arranged on a display surface of the display device.

10. The audio system according to claim 7, wherein the audio system is installed in a vehicle, wherein the displayed layout image comprises an image showing a layout obtained by viewing a dashboard of the vehicle and the vicinity of the dashboard from the inside of the vehicle; and wherein the relationship-information calibrating section changes the delay-time difference determined by the delay units to be applied to the audio signals supplied to the respective speakers so that the localization position of the sound image moves in a left-and-right direction of the vehicle, and wherein the input of a position on the displayed layout image is a vehicle left-and-right-direction position corresponding to an on-layout-image left-and-right-direction position received by the relationship-information calibrating section, the vehicle left-and-right-direction position being a perceived vehicle left-and-right-direction localization position of the sound image of audio sound produced from the speakers and aurally perceived by the user.

11. The audio system according to claim 7, wherein the audio system is installed in a vehicle, wherein the displayed layout image comprises an image showing a layout obtained by viewing a dashboard of the vehicle and the vicinity of the dashboard from the inside of the vehicle; and wherein the relationship-information calibrating section changes the delay-time difference determined by the delay units to be applied to the audio signals supplied to the respective speakers so that the localization position of the sound image moves in a left-and-right and up-and-down direction of the vehicle, and wherein the input of a position on the displayed layout image is a vehicle left-and-right and up-and-down-direction position corresponding to an on-layout-image left-and-right and up-and-down direction position received by the relationship-information calibrating section, the vehicle left-and-right and up-and-down-direction position being a perceived vehicle left-and-right and up-and-down direction localization position of the sound image of audio sound produced from the speakers and aurally perceived by the user.

12. The audio system according to claim 7, wherein the audio system is installed in a vehicle.

wherein the displayed layout image is an image showing an in-vehicle horizontal layout; and wherein the relationship-information calibrating section changes the delay-time difference determined by the delay units to be applied to the audio signals supplied to the respective speakers so that the localization position of the sound image moves in a left-and-right and front-and-rear direction of the vehicle, and wherein the input of a position on the displayed layout image is a vehicle left-and-right and front-and-rear direction position corresponding to an on-layout-image left-and-right and up-and-down direction position received by the relationship-information calibrating section, the vehicle left-and-right and front-and-rear-direction position being a perceived vehicle left-and-right and front-and-rear direction localization position of the sound image of audio sound produced from the speakers and aurally perceived by the user.

13. A localization-position adjusting method for adjusting a localization position of a sound image of audio sound produced from a plurality of speakers in an audio system having the plurality of speakers for producing audio sound; an audio source apparatus for supplying, to the respective speakers, audio signals expressing the audio sound to be produced from the speakers; and delay units for determining a delay-time difference between the audio signals supplied from the audio source apparatus to the respective speakers, the localization-position adjusting method comprising:

receiving, from a user, a desired localization position of a sound image of audio sound produced from the speakers and causing the delay units to determine a delay-time difference between the audio signals supplied to the respective speakers, the delay-time difference being determined based on relationship information indicating a relationship between a predetermined delay-time difference and a localization position of a sound image of audio sound produced from the speakers; and modifying, upon receiving from the user an input of a perceived localization position of a sound image of audio sound produced from the speakers and aurally perceived by the user, the relationship indicated by the relationship information so as to correspond to an association between the perceived localization position received from the user and a first delay-time difference determined by the delay units for the audio signals supplied to the respective speakers when the user aurally perceived the localization position, and causing the delay units to determine a delay-time difference to be applied to the audio signals supplied to the respective speakers, the delay-time difference being determined in accordance with the modified relationship information so that the image sound of the audio sound is localized to the desired localization position that was received.

14. The localization-position adjusting method according to claim 13, wherein a layout image showing a layout of a listening space of the audio sound is displayed, wherein a first input of a position on the displayed layout image is received, and a position in the listening space corresponding to the first input of a position on the displayed layout image is designated as the desired localization position, and wherein a second input of a position on the displayed layout image is received, and a position in the listening space corresponding to the second input of a position on the displayed layout image is designated as the perceived localization position of a sound image of audio sound produced from the speakers and aurally perceived by the user.

15. The localization-position adjusting method according to claim 13, wherein the listening space of the audio sound comprises a space in the vehicle and the layout image comprises an image showing a state in the vehicle.

16. A localization-position calibrating method for an audio system having a plurality of speakers for producing audio sound; an audio source apparatus for supplying, to the respective speakers, audio signals expressing the audio sound to be produced from the respective speakers; delay units for determining a delay-time difference between the audio signals supplied from the audio source apparatus to the speakers; and a delay-time difference controller for causing the delay units to give a delay-time difference between the audio signals supplied to the respective speakers, the delay-time difference being determined in accordance with relationship information indicating a relationship between a predetermined delay-time difference and a localization position of a sound image of audio sound produced from the speakers, the method comprising:

receiving, from a user, at least one perceived localization position of a sound image of audio sound produced from the speakers and aurally perceived by the user, the at least one localization position being received while changing the delay-time difference determined by the delay units for the audio signals supplied to the respective speakers; and calibrating the relationship indicated by the relationship information so as to correspond to an association between each perceived localization position whose input was received and a corresponding delay-time difference determined by the delay units for the audio signals supplied to the respective speakers when the user aurally perceived the localization position.

17. The localization-position calibrating method according to claim 16, wherein a layout image showing a layout of a listening space of the audio sound is displayed, wherein an input of a position on the displayed layout image is received, and a position in the listening space corresponding to the input of a position on the displayed layout image is designated as the perceived localization position of a sound image of audio sound produced from the speakers and aurally perceived by the user.

18. The localization-position adjusting method according to claim 16, wherein the listening space of the audio sound comprises a space in the vehicle and the layout image comprises an image showing a state in the vehicle.

* * * * *